US005502997A

United States Patent [19]

Boettger et al.

[11] Patent Number: 5,502,997

[45] Date of Patent: Apr. 2, 1996

[54] GRIPPER AND MANDREL ASSEMBLY FOR TUBE BENDER

[75] Inventors: John M. Boettger, Manchester; Frank Guliuzza, Jr., Wallingford, both of Conn.

[73] Assignee: Carrier Corporation, Syracuse, N.Y.

[21] Appl. No.: 359,166

[22] Filed: Dec. 19, 1994

[51] Int. Cl.[6] ..... B21D 9/03

[52] U.S. Cl. ..... 72/466; 72/296; 72/370

[58] Field of Search ..... 72/466, 465, 296, 72/297, 370, 150

[56] References Cited

U.S. PATENT DOCUMENTS

| | | | |
|---|---|---|---|
| 1,494,128 | 5/1924 | Primrose | 72/370 |
| 1,826,077 | 10/1931 | Johnson . | |
| 2,357,123 | 8/1944 | Maxwell | 72/465 |
| 2,739,634 | 3/1956 | Gray et al. | 153/32 |
| 2,962,919 | 12/1960 | Grundmann et al. | 81/186 |
| 3,408,851 | 11/1968 | Sassak | 72/466 |
| 3,650,140 | 3/1972 | Zmuda | 72/296 |
| 4,123,930 | 11/1978 | Hill et al. | 72/466 |
| 4,135,380 | 1/1979 | Olszewski | 72/306 |
| 4,315,423 | 2/1982 | McGuire | 72/466 |
| 4,475,375 | 10/1984 | Hill | 72/466 |
| 4,524,600 | 6/1985 | Champoux | 72/370 |
| 4,542,637 | 9/1985 | McGuire | 72/466 |
| 4,602,495 | 7/1986 | Yarnell | 72/370 |
| 4,635,464 | 1/1987 | McGuire et al. | 72/466 |
| 4,671,096 | 6/1987 | Crosby | 72/466 |
| 4,827,753 | 5/1989 | Moroney | 72/296 |
| 5,327,765 | 7/1994 | Weykamp et al. | 72/296 |

*Primary Examiner*—Daniel C. Crane

[57] ABSTRACT

A gripper and mandrel assembly for a tube bender, particularly a bender of the stretch type. At least two gripper jaws close about an end of a tubular workpiece when actuated by the cone portion of a slideable shaft. The same shaft has a cable and ball type mandrel extending outwardly from its distal end. During a stroke of the shaft from the DISENGAGE to the ENGAGE position of the assembly, the shaft both drives the mandrel into the workpiece and also causes the jaws to close about the end of the tube. When in the ENGAGE position, the distal end of the shaft is inside the tube in order to prevent the gripper jaws from deforming or otherwise causing excessive damage to the workpiece end. An abrasive coating partially covers the inner surface of the recess of the gripper jaw that contacts the outer wall of the workpiece in order to insure a firm grasp of the workpiece by the gripper jaws. A tube bender would have at least two assemblies, one to grasp each end of a tubular workpiece.

7 Claims, 3 Drawing Sheets

GRIPPER AND MANDREL ASSEMBLY FOR TUBE BENDER

BACKGROUND OF THE INVENTION

This invention relates generally to the field of apparatus for bending tubes. More particularly, the invention is a gripper and mandrel assembly for use in a tube bender. The assembly assures a firm grip on the tube and controls wrinkling of the tube wall and interior cross sectional area during a bending operation. The invention is particularly suited for use in a stretch-type tube bender. The invention was conceived for use in a tube bender that makes return bends for air-to-refrigerant heat exchangers in air conditioning and refrigeration systems but could be used for bending tubes for other purposes as well.

A typical air conditioning or refrigeration air-to-refrigerant heat exchanger is a system of tubing through which refrigerant flows. Air flows over the tube exterior and heat transfers through the tube wall from the fluid having the higher temperature to the other fluid. Such a heat exchanger is typically manufactured by passing a number of U-shaped tubes, called "hairpins," through tubesheets and, in most cases, a stack of plate fins. The tubesheets maintain the tubes in a predetermined relationship with each other and give the heat exchanger increased physical strength. The plate fins increase the external surface area of the tube and thus improve heat transfer performance. The plate fins also give increased strength and rigidity to the assembly. After "lacing" the tubes through the tubesheets and fin stacks, two ends of adjacent hairpins are joined with a short U-shaped tube, called a "return bend," to form a single flow path between the two hairpins. Not every hairpin end will be joined with a return bend but the typical heat exchanger will have a large number of return bends. The air conditioning and refrigeration industry makes and uses millions of return bends yearly.

In manufacturing return bends, it is necessary that there be no "peglegged" return bends, that is, the legs of the return bend must be exactly the same length. It also necessary that the exterior wall of the return bend adjacent each of its ends be smooth and undamaged. These requirements must be met so that the joint between a return bend and a hairpin will fit up correctly and then can be brazed, welded or soldered to become fluid tight.

In several types of tube benders, including the stretch type, one or both of the ends of the workpiece being bent must be securely grasped in order to effect the bend. Obtaining a good grip on an end often results in damage to the workpiece in the area at the end being gripped. Sometimes the damage is sufficient to make trimming off the damaged end necessary.

A prior art manufacturing process for making return bends that is in current widespread use uses a rotary draw bender. This process produces return bends with legs that are longer than required. After bending, the excess length in the return bend legs is cut off A saw-like cutting tool must be used so that this process produces saw chips and results in a great deal of scrap, both from the excess length of tube cut off as well as the chips produced in the cutting process. After cutting, chips from the saw cutting must be removed from the finished return bends, a process that involves the use of cleaning chemicals. In a large scale return bend manufacturing operation, the amount of scrap and chemical waste produced can be considerable.

In order to insure that proper fluid flow rates are attained in a tube type heat exchanger, it is necessary that the inside cross sectional area of all portions the completed fluid flow path be at least some minimum value. A tube bending operation frequently wrinkles that portion of the tube wall that is on the inside of the bend as well and flattens that portion of the tube wall that is on the outside of the bend. Both wrinkling and flattening can result in reduction in the cross sectional area of the bent tube, a reduction that may result in a cross sectional area that is below the minimum acceptable value.

What is needed is a tube bender that can make return bends with precisely controlled dimensions while producing a minimum of scrap.

SUMMARY OF THE INVENTION

The present invention, a gripper and mandrel assembly, is used in a tube bender using a modified stretch bending process. The gripper can grasp a tube end with sufficient holding force to enable bending using the stretch bending process while leaving the tube end in a condition that is satisfactory for fitting up and brazing, welding or soldering in a joint. In stretch bending, the length of the workpiece can be controlled so that the possibility of peglegs is eliminated. The prior art requirement to trim the legs of return bends after bending is thus eliminated and the amount of scrap produced is greatly reduced. The mandrel controls the wrinkling of the tube wall on the inside of the bend and prevents flattening so that the desired minimum cross section in the turn bend is maintained.

The jaws of the gripper each have a recess that surround and enclose the end of a tube when the jaws are engaged. The surface of a recess is partially coated with a matrix that fixes abrasive particles to the surfaces. Standards exist for the maximum roughness allowable before the surface of a tube is unacceptable for making into a joint. The thickness of the matrix and the particle size are controlled so that the maximum protrusion of a particle from the surface of the matrix is no more than the maximum allowable penetration under the roughness standard. That portion of the recess surface that would, if covered with the abrasive matrix, scratch the tube wall when the jaw is engaging and disengaging the tube is left uncoated.

The mandrel is of the cable and ball type and is fixed to the end of the gripper operating shaft. During the engage stroke, the shaft both drives the mandrel into the tube and causes the gripper jaws to clamp down around the end of the tube. During the disengage stroke, the shaft both withdraws the mandrel from the tube and allows the gripper jaws to disengage the end of the tube. The cable of the mandrel is spring loaded. The spring maintains tension on the cable and thus causes the mandrel bails to tend toward a straight alignment. This facilitates the entry of the mandrel into the tube. The alignment of the balls must become curved as the tube is bent. The bending force overcomes the spring force and enough cable can then pay out to allow the balls to conform to the curvature of the bent tube.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Figure 2:
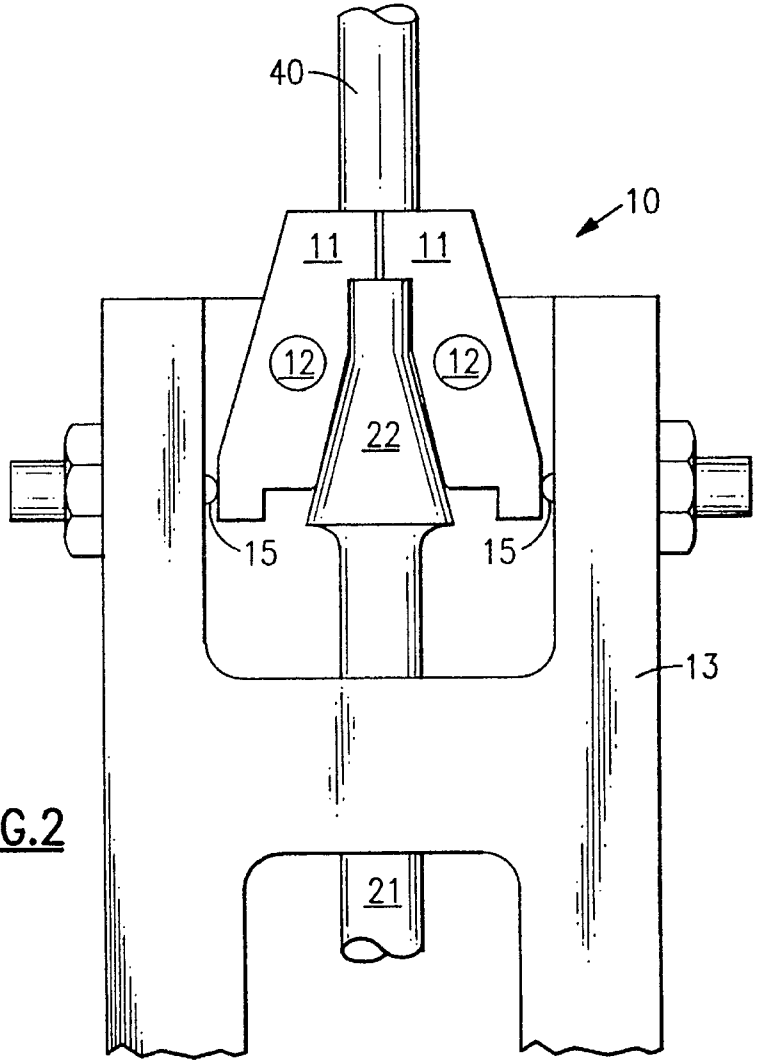
FIG. 2 is a view of the gripper and mandrel assembly when the assembly is in the ENGAGE position.
Figure 1:
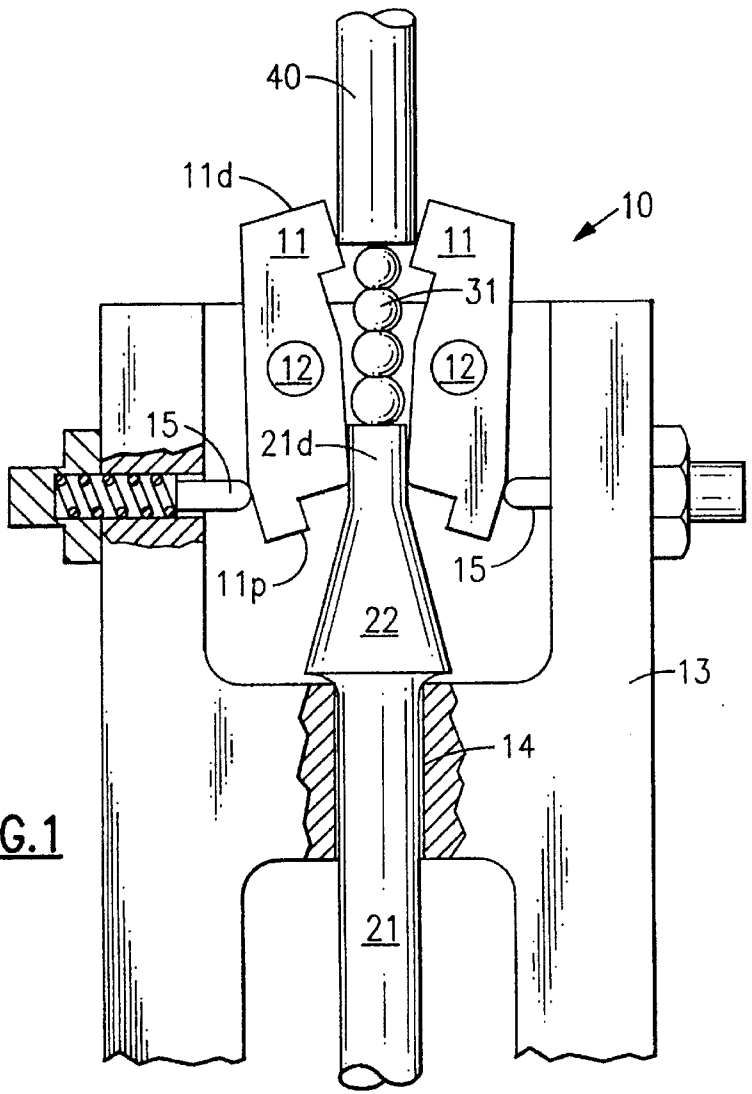
FIG. 1 is a view of the gripper and mandrel assembly of the present invention when the assembly is in the DISENGAGE position.

FIGS. 1 and 2 respectively show the gripper and mandrel assembly of the present invention in its two positions, DISENGAGE and ENGAGE. Assembly 10 has frame 13 to which are attached gripper jaws 11 by means of pins 12. A jaw 11 can pivot about its pin 12. Each jaw has a distal end lid and a proximal end 11*p*. Spring loaded plungers 15 urge proximal ends 11*p* toward each other. As proximal ends 11*p* move toward each other, distal ends 11*d* move away from each other. Operating shaft 21 is slideably attached to frame 13 through beating 14. There is a conical section 22 near but not at distal end 21*p* of shaft 21. Shaft 21 is moved by some source of motive power such as a hydraulic actuator (not shown). Mandrel 31 is attached at its proximal end 31*p* to distal end 21*d*. Tubular workpiece 40 is in position to be grasped by gripper jaws 11.

In the DISENGAGE position (FIG. 1), shaft 21 is located at its full length of travel in a direction away from workpiece 40. In this position, jaws 11 are fully open, that is, the distal ends 11*p* of jaws 11 are at the maximum distance from each other. Mandrel 31 is fully withdrawn from workpiece 40. Assembly 10 would be in the DISENGAGE position, ready to receive a workpiece, at the start of a bending operation and also at the end of a bending operation, so that a workpiece that has been bent can be removed.

In the ENGAGE position (FIG. 2), shaft 21 is located at its full length of travel toward workpiece 40. In the stroke of shaft 21, conical section 22 has caused jaw proximal ends 11*p* to move away from each other and thus distal ends 11*d* to move together, gasping, in a manner described below, workpiece 40. The movement of shaft 21 has also caused mandrel 31 (not shown in FIG. 2) to be inserted into workpiece 40. Assembly 10 would be in the ENGAGE position during a bending operation.

Figure 3:
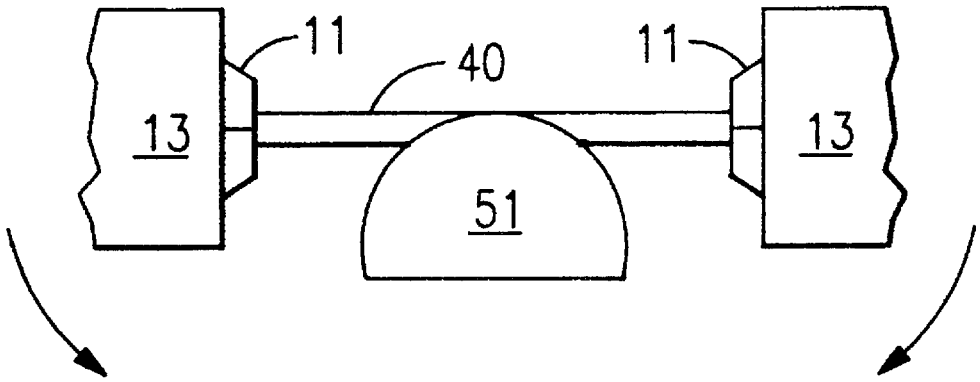
FIG. 3 is a plan view of a tube bender embodying the present invention positioned for a bending operation.
Figure 4:
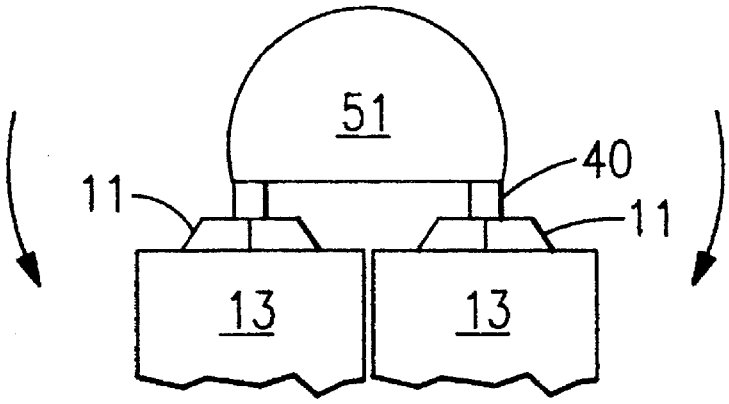
FIG. 4 is a plan view of a tube bender embodying the present invention after a bending operation.

FIGS. 3 and 4, in skeleton plan views, show how the gripper and mandrel assembly of the present invention is used in a tube bender. Assemblies are used in pairs, with one required for each end of a tubular workpiece. Frames 13 are mounted in the bender in such a way that they can be rotated about a point. After mandrels 31 (not shown in FIGS. 3 and 4) are inserted into the ends of tubular workpiece 40 and jaws 11 grasp the ends, the frames are positioned so that workpiece 40 is in contact with bend die 51 (FIG. 3). The frames are then rotated by the are necessary to obtain the desired bend in the workpiece (FIG. 4). For a return bend, this are would of course be 90 degrees.

Figure 5:
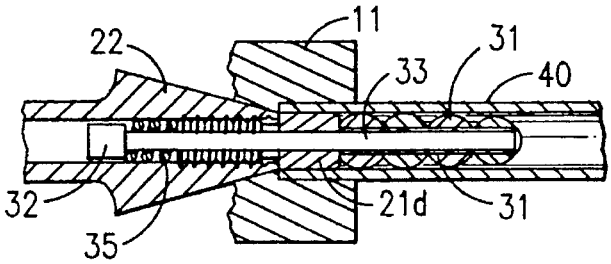
FIG. 5 is a sectioned elevation view of a tubular workpiece with the mandrel inserted and the gripper engaged before the bending operation.

FIG. 5 shows, in a sectioned view, a portion of a tube with a mandrel inserted and grippers engaged and before a bending operation. Only one half of the tube is shown, the other half would be a mirror image. Mandrel 31 comprises several perforate balls 32 attached to each other and to distal end 21*d* by cable 33. To enable easier insertion and removal of the mandrel, each successive ball, from the distal to the proximal end of mandrel 31, is slightly smaller in diameter than its closer-in neighbor. Cable 33 extends through a hole in distal end 21*d* and terminates in cable proximal end 34. Spring 35 urges cable 33 into distal end 21*d* so that cable 33 tends to keep mandrel 31 straight and in alignment when assembly 10 is in the DISENGAGE position and also while shaft 21 is driving mandrel 31 into workpiece 40. When assembly 10 is in the ENGAGE position, distal end 21*p* extends into the end of workpiece 40 to prevent deformation of the end by the action of gripper jaws 11.

Figure 6:
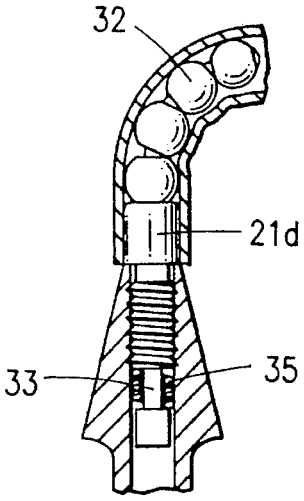
FIG. 6 is a sectioned elevation view of a tubular workpiece with the mandrel inserted and the gripper engaged after the bending operation.

FIG. 6 shows the same tube as in FIG. 5 but after the completion of the bending operation. The bending has caused more of cable 33 to be drawn out of distal end 21*p* and thus spring 35 is compressed. Mandrel balls 32 have kept the workpiece from flattening and also controlled the way the workpiece wall has wrinkled on the inside of the bend.

Figure 7:
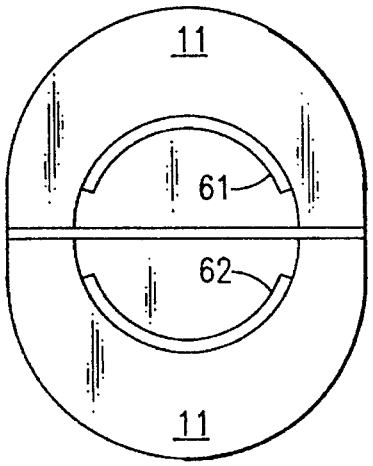
FIG. 7 is a front elevation view of the gripper of the present invention.
Figure 8:
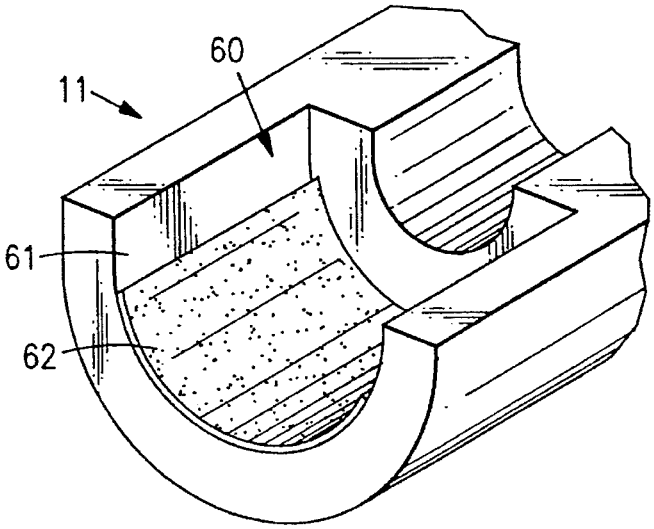
FIG. 8 is an isometric view of a portion of one jaw of the gripper of the present invention.

FIG. 7, in a front elevation view, depicts gripper jaws 11 when assembly 10 is in the ENGAGE position. FIG. 8, in an isometric view, depicts distal end 11*d* of one gripper jaw 11. Gripper jaw 11 has a semicircular recess in distal end 11*d* that, when assembly 10 is in the ENGAGE position, surrounds and grasps the end of a tubular workpiece. In order to insure that jaw 11 can take a firm grasp on the end of a workpiece, a portion of inner surface 61 is covered with abrasive coating 62. In a preferred embodiment, abrasive coating 62 comprises diamond particles embedded in a braze metal matrix. It can be determined what the maximum penetration by the diamond particles into the exterior surface of the workpiece must be in order not to damage the surface so much that it is unacceptable for use in a joint. The diamond particles are chosen so that no particle has a maximum dimension that is more than twice the predetermined maximum penetration depth. The matrix in which the particles are embedded is then made with a thickness that is half that same predetermined maximum penetration depth. The result is that no particle protrudes above the matrix to a distance that is greater than the predetermined maximum penetration depth. Only a portion of surface 61 is covered with coating 62. Those portions of surface 61 that are adjacent the flat portion of jaw 11 that comes in contact with its opposing jaw are left without a coating. This is to avoid scratching the exterior surface of the workpiece when the jaws open and close.

We claim:

1. A gripper and mandrel assembly (10) for a tube bender comprising:

a frame (13);

at least two gripper jaws (11), each of said jaws having a distal end (11*d*) and a proximal end (11*p*), pivotably mounted on said frame so that movement of said proximal ends away from each other results in movement of said distal ends toward each other;

a recess (60) for grasping a tubular workpiece in each of said distal ends of said gripper jaws;

an operating shaft (21), having cone portion (22) and a distal end (21*d*), slideably mounted on said frame so that said shaft, including said cone portion, can pass between said proximal ends of said gripper jaws to cause said jaws to pivot; and a flexible mandrel (31) mounted on said distal end of said operating shaft and arranged to be inserted into the tubular workpiece so as to flex during bending of the workpiece preventing wrinkling or flattening of the workpiece.

2. The gripper and mandrel assembly of claim 1 in which said recess has an inner face (61) that is partially covered with an abrasive coating (62).

3. The gripper and mandrel assembly of claim 2 in which said abrasive coating comprises abrasive particles embedded in a matrix material.

4. The gripper and mandrel assembly of claim 3 in which said abrasive coating comprises diamond particle chips embedded in a braze metal matrix.

5. The gripper and mandrel assembly of claim 1 in which said gripper jaws have an ENGAGE position and a DISENGAGE position and said cone portion, when said cone portion is fully inserted between said proximal ends of said gripper jaws, causes said gripper jaws to be in said ENGAGE position and when said cone portion is withdrawn from between said proximal ends of said gripper jaws, urging means (15) acting on said proximal ends of said gripper jaws cause said gripper jaws to move to said DISENGAGE position.

6. The gripper and mandrel assembly of claim 1 in which said mandrel comprises a perforate ball through which a cable passes.

7. The gripper and mandrel assembly of claim 6 further comprising means for urging said cable to retract into said distal end of said operating shaft.

* * * * *